US009746280B2

(12) United States Patent
Huang et al.

(10) Patent No.: US 9,746,280 B2
(45) Date of Patent: Aug. 29, 2017

(54) PRESSURE REGULATOR FOR PAINT BALL GUN

(71) Applicants: Chung Wei Huang, Taichung (TW); Wen-Hung Li, Taichung (TW); Cheng Yu Huang, Taichung (TW)

(72) Inventors: Chung Wei Huang, Taichung (TW); Wen-Hung Li, Taichung (TW); Cheng Yu Huang, Taichung (TW)

( * ) Notice: Subject to any disclaimer, the term of this patent is extended or adjusted under 35 U.S.C. 154(b) by 54 days.

(21) Appl. No.: 15/065,900

(22) Filed: Mar. 10, 2016

(65) Prior Publication Data

US 2016/0187098 A1 Jun. 30, 2016

(30) Foreign Application Priority Data

Jan. 19, 2016 (TW) ..... 105101449 A

(51) Int. Cl.
*F41B 11/724* (2013.01)

(52) U.S. Cl.
CPC ..... *F41B 11/724* (2013.01)

(58) Field of Classification Search
CPC ..... F16B 21/09; F16B 5/0036; F16B 12/22; Y10T 403/64; Y10T 403/645
USPC ..... 137/270; 403/4, 108
See application file for complete search history.

(56) References Cited

U.S. PATENT DOCUMENTS 4,266,386 A * 5/1981 Bains ..... E04B 1/6116 52/481.2
4,784,046 A * 11/1988 Gautier ..... B60T 13/5675 248/222.41
5,716,154 A * 2/1998 Miller ..... B60R 11/00 403/22
7,654,782 B2 * 2/2010 Nilsen ..... F16B 37/061 29/525.05
8,511,954 B2 * 8/2013 Fink ..... F16B 5/0036 280/728.2
8,991,378 B2 * 3/2015 Newman ..... F41B 11/72 124/71

* cited by examiner

*Primary Examiner* — John Fox

(57) ABSTRACT

A pressure regulator for paint ball gun includes a first housing including a hollow projection on a first end surface, an axial channel through the projection, and a connector on a second end surface; an output pressure gauge on the first housing; a check valve on the first housing; a pressure regulation assembly including a sleeve fastened in the channel and having an axial tunnel, a biasing member in the tunnel, and a hub on the biasing member; a hollow second housing including an internal space with the projection disposed therein, and holes on an end, each hole having overlapping circular portions and of larger and smaller sizes; and fasteners through the overlapping circular portions of smaller size of the holes into the first housing. In an unfastened state of the second housing, the fasteners are through the overlapping circular portions of larger size of the holes.

1 Claim, 9 Drawing Sheets

PRESSURE REGULATOR FOR PAINT BALL GUN

BACKGROUND OF THE INVENTION

1. Field of the Invention

The invention relates to gas pressure regulators and more particularly to a pressure regulator for a paint ball gun.

2. Description of Related Art

A conventional pressure regulator for a paint ball gun comprises a hollow cylinder, a hollow piston, an elastic member, a top connector, and a switch bolt. The cylinder comprises an upper chamber and a lower chamber. A separation plate is provided between the upper chamber and the lower chamber. A through hole is provided on the separation plate. An air hole is provided in an upper section of the lower chamber to guide pressurized air to flow into the lower chamber. An upper edge of the upper chamber and a middle section of the lower chamber are threaded. The piston comprises a ring plate and a tube, the ring plate having an outer diameter corresponding in size to an inner diameter of the upper chamber in the cylinder, the tube having an outer diameter corresponding in size to an inner diameter of the through hole of the separation plate of the cylinder. An upper end of the tube being is secured to an inner edge of the ring plate. The tube has a closed lower end and a side hole near the lower end. The elastic member is sleeved the piston. The top connector is hollow and has a lower end. The lower end of the top connector is externally threaded secured to the thread in the upper chamber of the cylinder. The switch bolt has a cylindrical opening disposed on an inner side of an upper section corresponding to the tube of the piston. The switch bolt is externally threaded secured to the thread in the lower chamber of the cylinder. The piston and the elastic member are disposed in the upper chamber of the cylinder. The top connector is secured to the upper edge of the upper chamber with the upper end of the elastic member urging against the ring plate of the piston, the lower end of the elastic member urging against the separation plate of the cylinder, the ring plate urging against the lower end of the top connector, the switch bolt being secured to the lower chamber of the cylinder, and the tube of the piston sliding into the cylindrical opening of the switch bolt.

While the device enjoys its success in the market, continuing improvements in the exploitation of pressure regulator for paint ball gun of this type are constantly being sought.

SUMMARY OF THE INVENTION

It is therefore one object of the invention to provide a pressure regulator for paint ball gun or comprising a hollow first housing including a hollow projection on a first end surface, an axial channel through the projection and communicating with inside of the first housing, and a connector on a second end surface; an output pressure gauge disposed on the first housing and communicating with inside of the first housing; a check valve disposed on the first housing and communicating with inside of the first housing; a pressure regulation assembly including a sleeve threadedly fastened in the channel and having an axial tunnel communicating with inside of the first housing, a biasing member disposed in the tunnel, and a hub disposed on an end of the biasing member; a hollow second housing including an internal space with the projection disposed therein, and a plurality of holes on an end, each of the holes having overlapping circular portions and of larger and smaller sizes; fasteners driven through the overlapping circular portions of smaller size into the first housing to secure the second housing, the pressure regulation assembly, and the first housing together; a switch on the first housing and communicating with inside of the first housing; and a pressure relief valve on the first housing and communicating with inside of the first housing; wherein in an unfastened state of the second housing, the fasteners are configured to drive through the overlapping circular portions of larger size.

The above and other objects, features and advantages of the invention will become apparent from the following detailed description taken with the accompanying drawings.

DETAILED DESCRIPTION OF THE INVENTION

Figure 1:
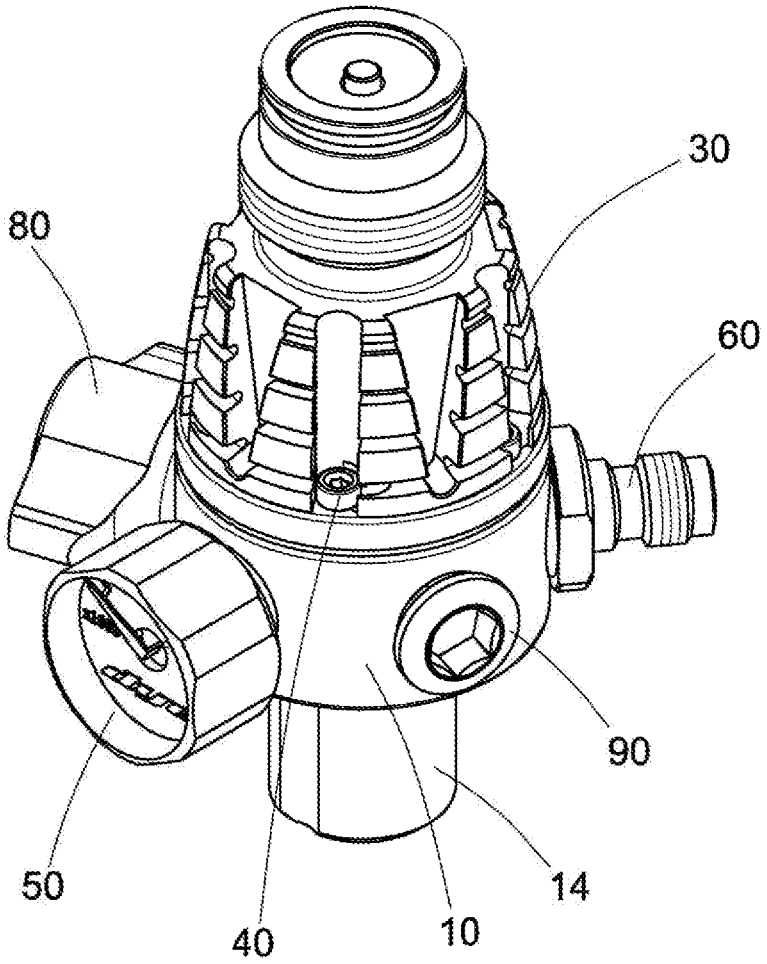
FIG. 1 is a perspective view of a pressure regulator for a paint ball gun according to the invention.
Figure 2:
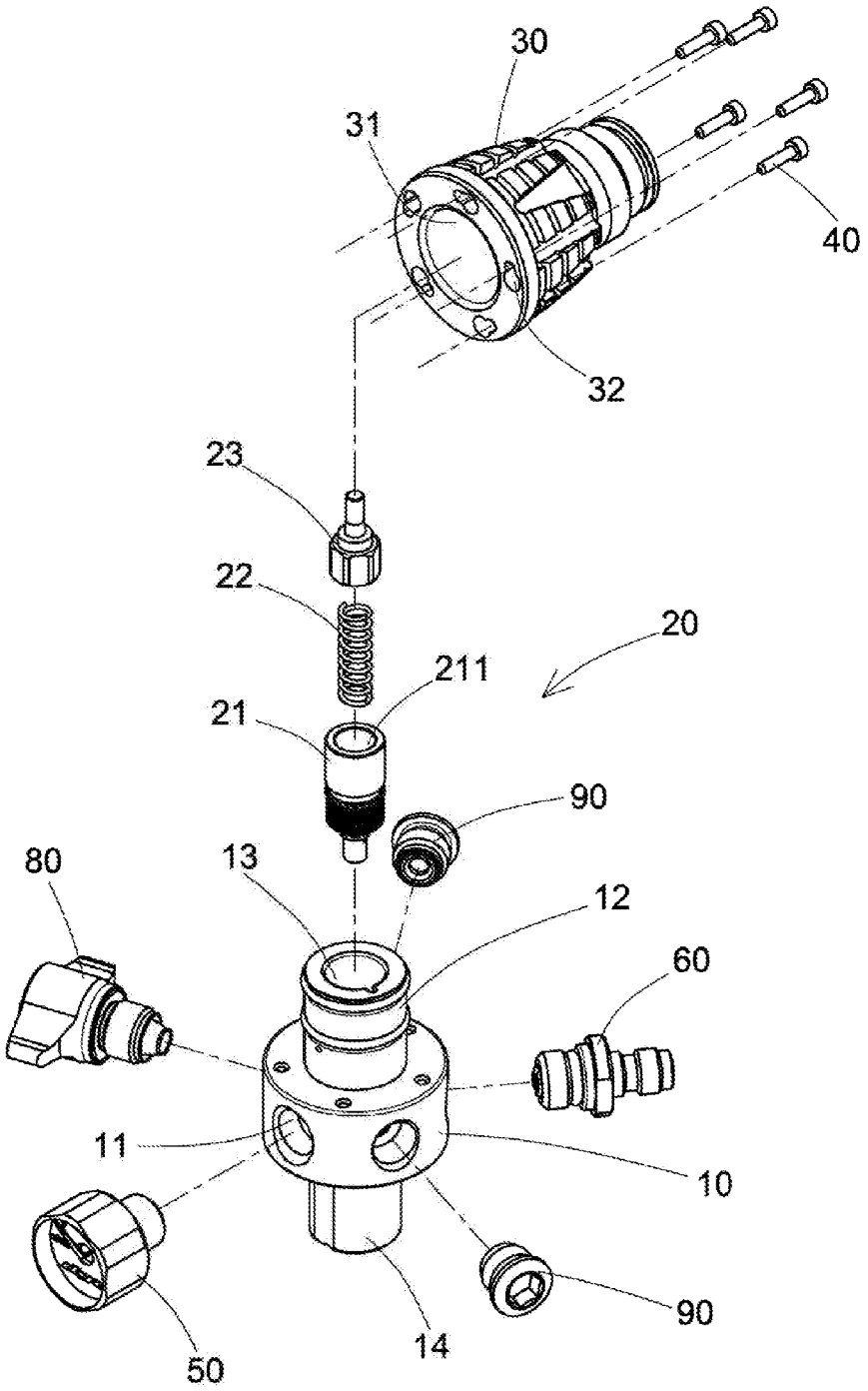
FIG. 2 is an exploded view of FIG. 1.
Figure 3:
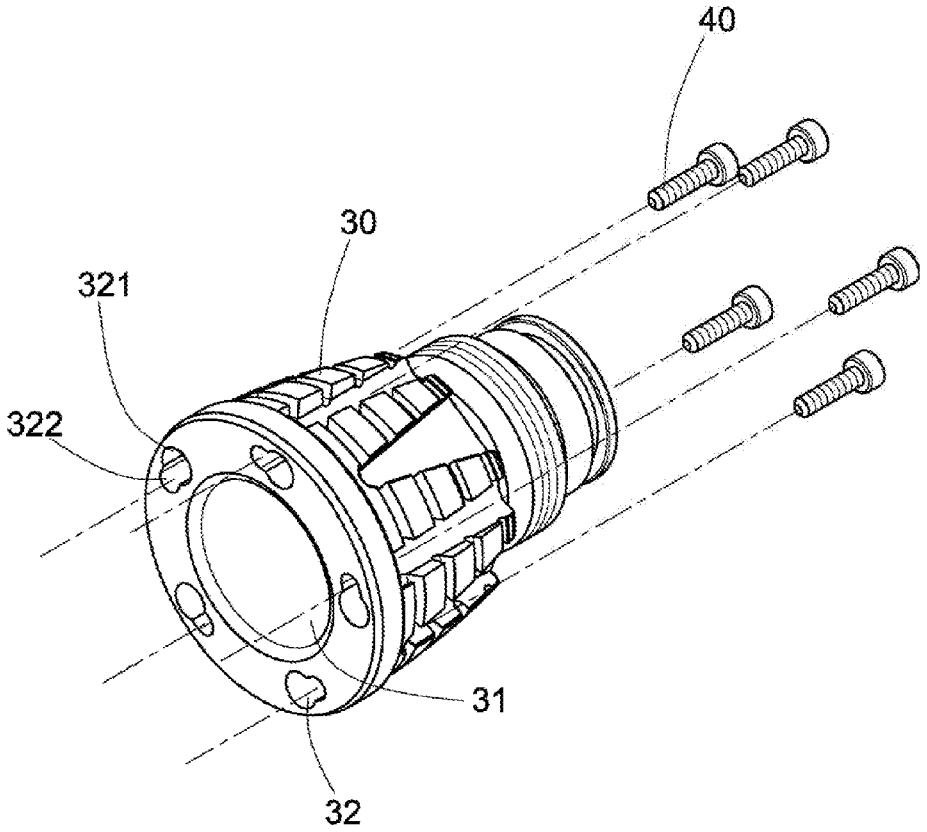
FIG. 3 is an enlarged view of the upper portion of FIG. 2.
Figure 4:
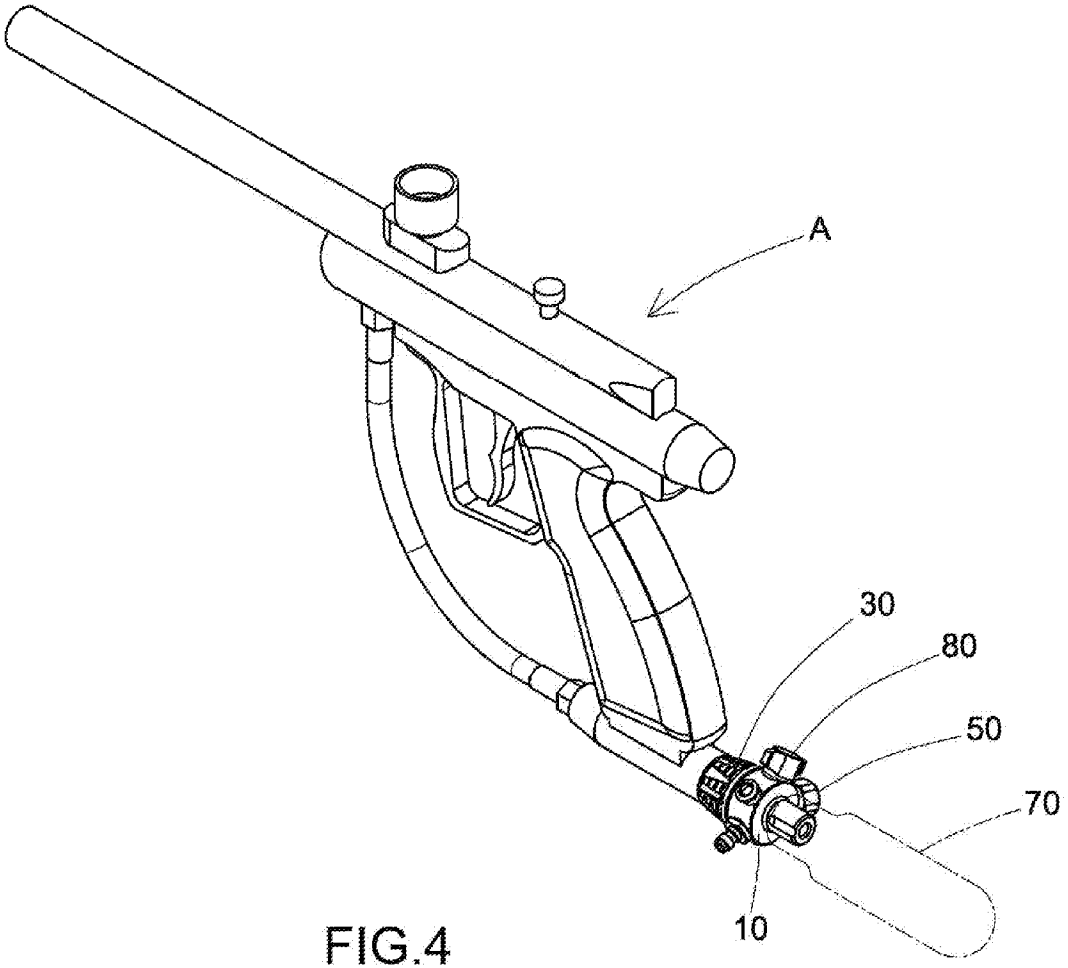
FIG. 4 is a perspective view of a paint ball gun equipped with the pressure regulator of the invention.
Figure 5:
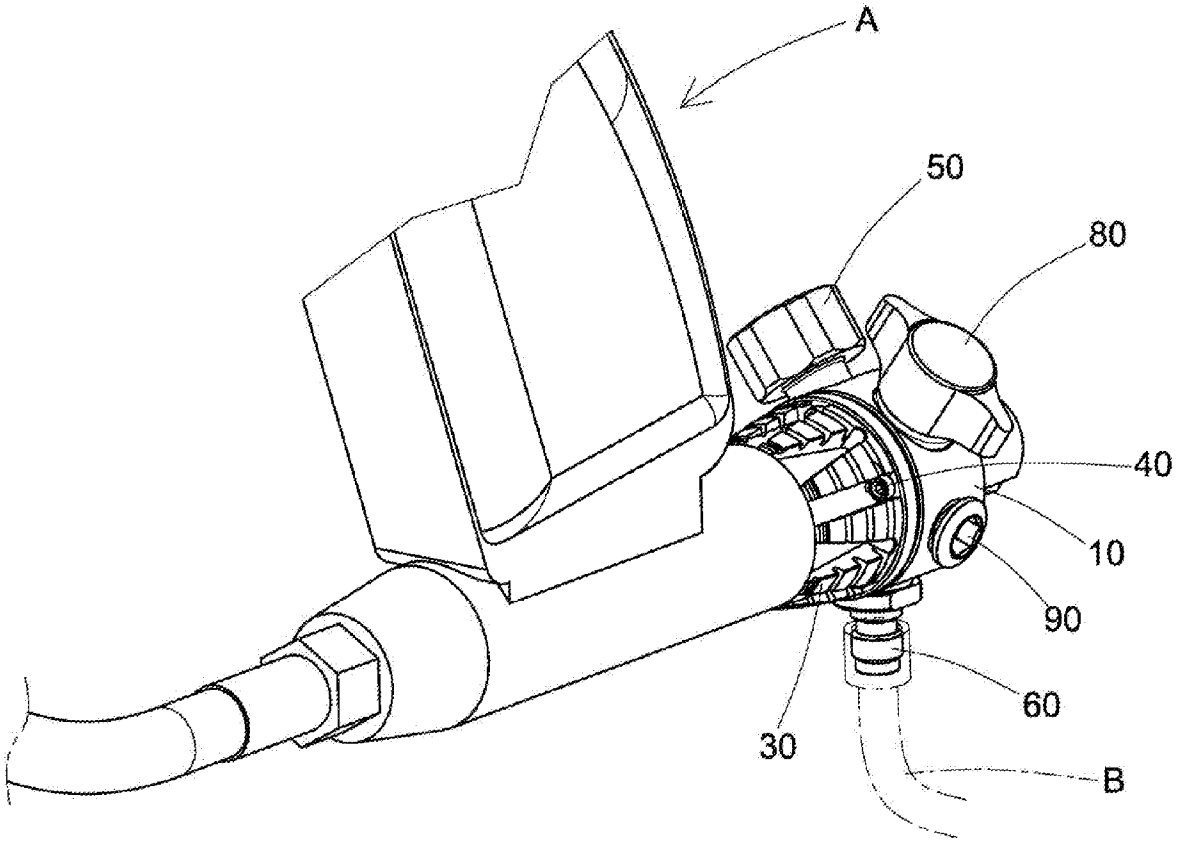
FIG. 5 is an enlarged view of the pressure regulator and adjacent components of FIG. 4.
Figure 6:
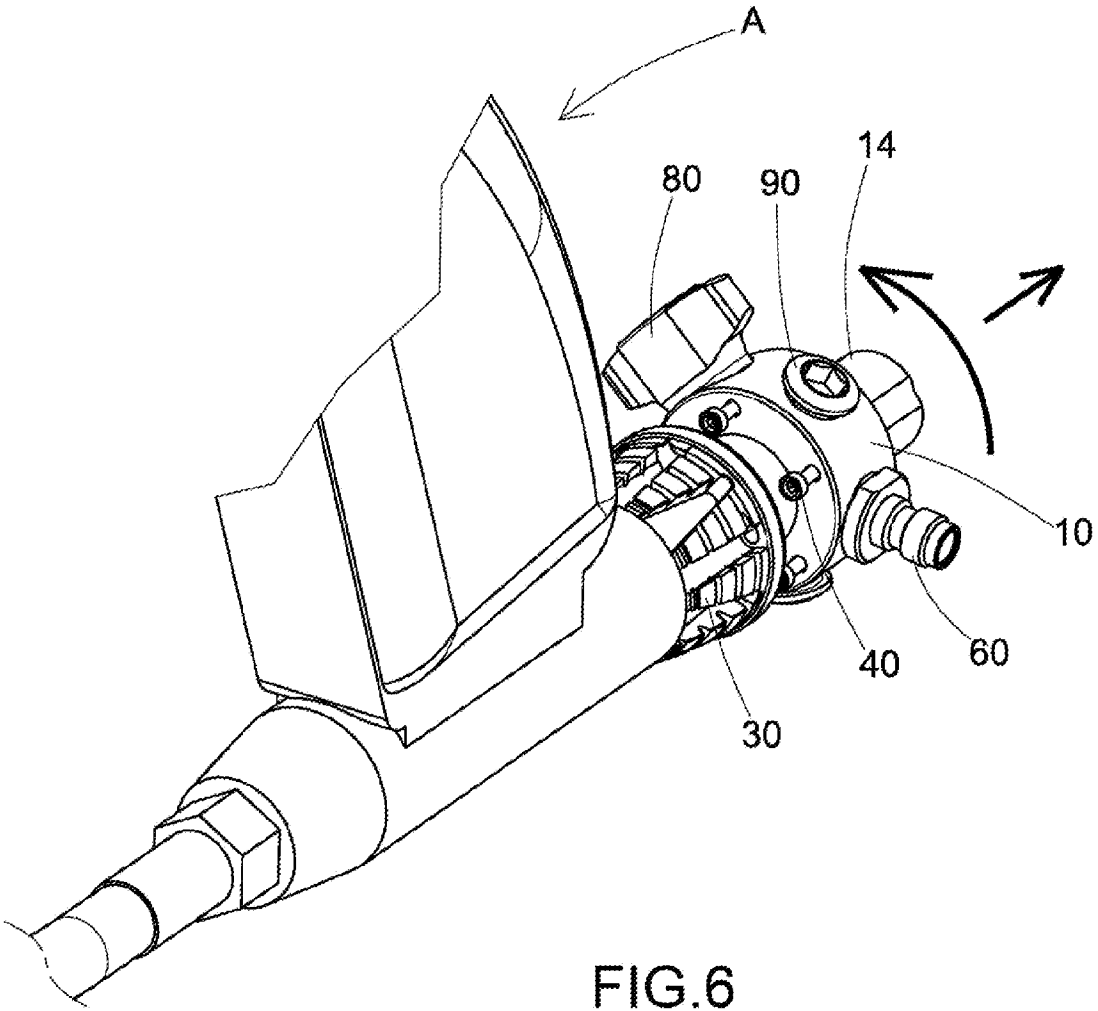
FIG. 6 is a view similar to FIG. 5 showing an angle adjustment of the second housing.
Figure 7:
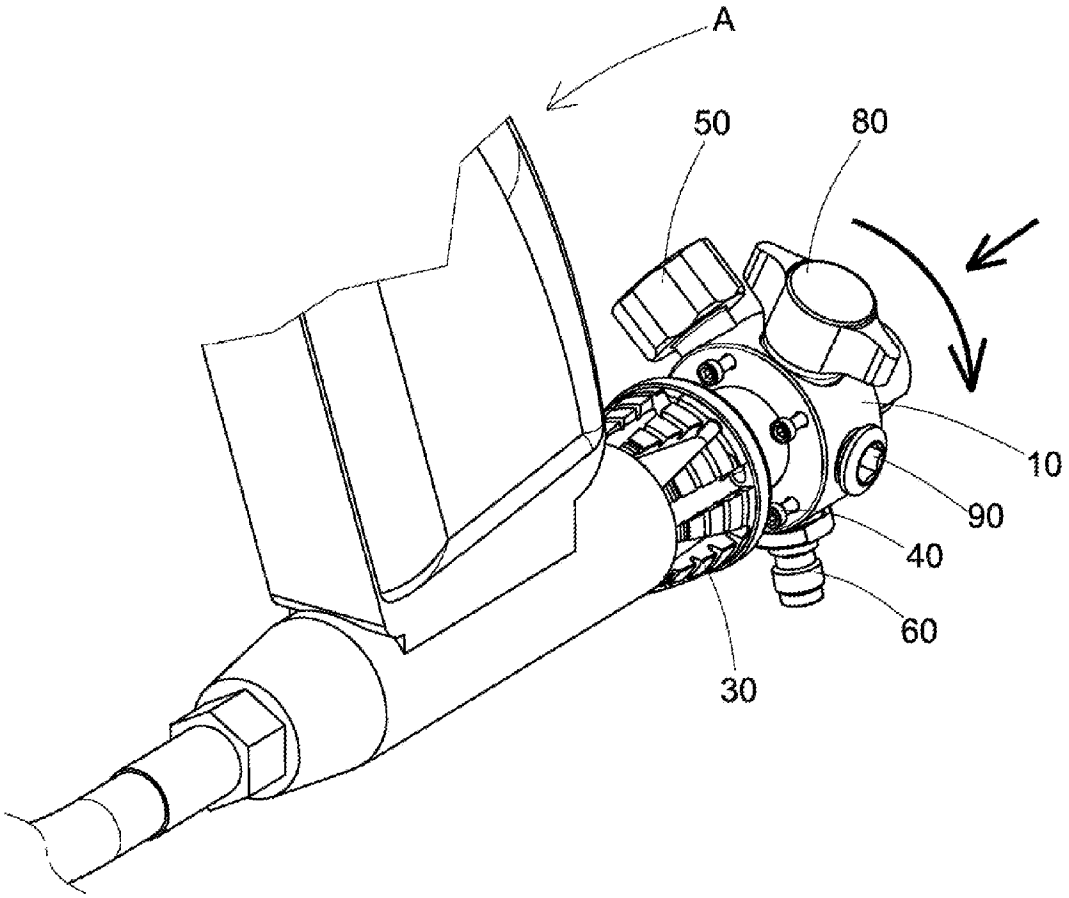
FIG. 7 is a view similar to FIG. 6 showing a reverse angle adjustment of the second housing.
Figure 8:
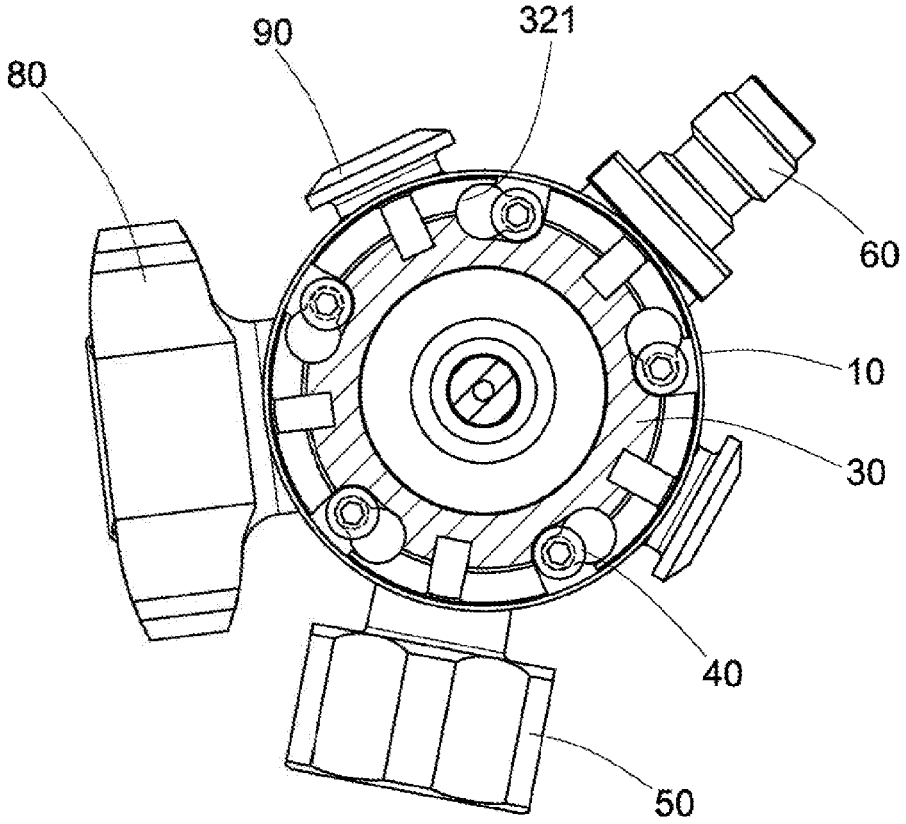
FIG. 8 is a top view in part section of FIG. 1.
Figure 9:
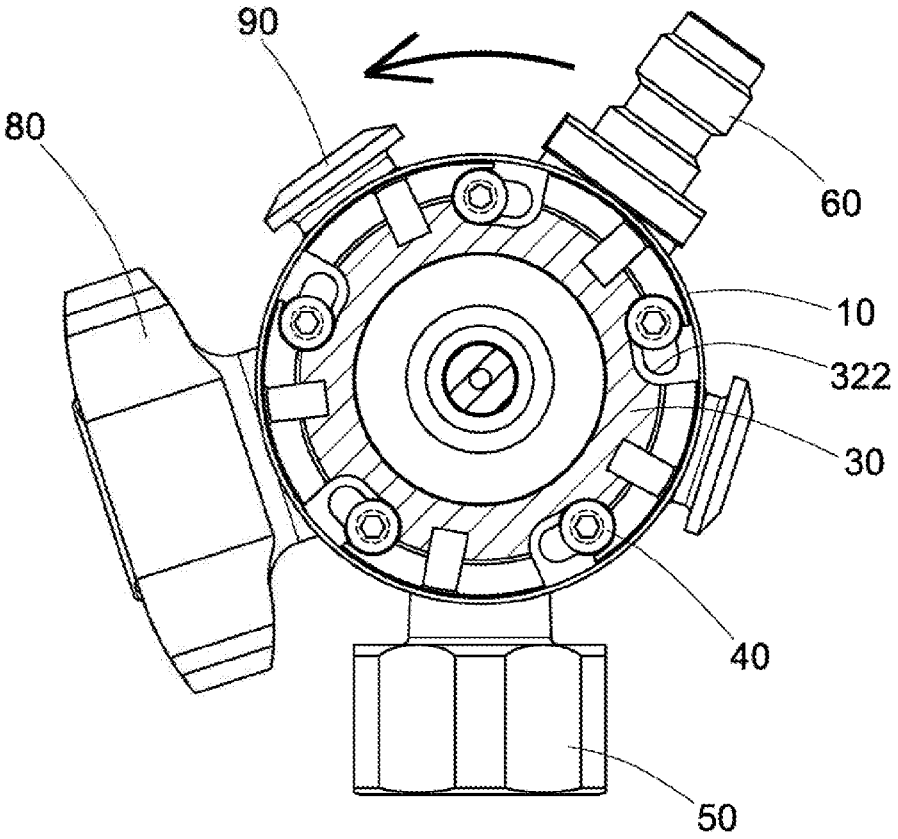
FIG. 9 is a view similar to FIG. 8 showing a counter-clockwise rotation of the pressure regulator for angle adjustment.

Referring to FIGS. 1 to 9, a pressure regulator for a paint ball gun A in accordance with the invention comprises the following components as discussed in detail below.

A cylindrical first housing 10 includes a plurality of equally spaced openings 11 on a periphery. An output pressure gauge 50 is mounted in one of the openings 11 and a check valve 60 is mounted in another opening 11. The first housing 10 further includes a hollow projection 12 on an end surface, an axial channel 13 through the projection 12 and communicating with the openings 11, and a connector 14 on an opposite end surface. A pressure regulation assembly 20 includes a sleeve 21 threadedly fastened in the channel 13 and having an axial tunnel 211 communicating with the openings 11, a torsion spring 22 disposed in the tunnel 211, and a pointed hub 23 disposed on an end of the torsion spring 22.

A hollow second housing 30 includes an internal space 31 with the projection 12 disposed therein, and a plurality of holes 32 equally spaced on an end, each hole 32 having overlapping circular portions 321 and 322 of larger and smaller sizes. A plurality of fasteners 40 are driven through the overlapping circular portions 322 of smaller size of the holes 32 into the first housing 10 to secure the second housing 30, the pressure regulation assembly 20, and the first housing 10 together. A supply tank 70 is filled with compressed air and has an opening secured to the connector 14. Thus, compressed air may flow to the first housing 10 via the connector 14. A switch 80 is mounted in another opening 11. An anti burst member (e.g., pressure relief valve) 90 is mounted in another opening 11.

As an alternative to the compressed air supplied by the supply tank 70, a hose B may have one end connected to the check valve 60 and the other end connected to a pump (not shown). Thus, compressed air supplied from the pump may flow to the first housing 10 via the check valve 60.

For adjusting an angle of the pressure regulator relative to the paint ball gun A, a user may unfasten the fasteners 40 and move the fasteners 40 to the overlapping circular portions 322 of larger size of the holes 32. Next, rotate the second housing 30 a desired angle (see FIG. 6). Next, move the fasteners 40 to the overlapping circular portions 321 of smaller size of the holes 32. Finally, oppositely rotate the second housing 30 (see FIG. 7). As a result, an angle adjustment of the second housing 30 is finished. Therefore, the user may clearly see the pressure gauge 40 in operation.

While the invention has been described in terms of preferred embodiments, those skilled in the art will recognize that the invention can be practiced with modifications within the spirit and scope of the appended claims.

What is claimed is:

1. A pressure regulator comprising:

a hollow first housing including a hollow projection on a first end surface, an axial channel through the projection and communicating with inside of the first housing, and a connector on a second end surface;

an output pressure gauge disposed on the first housing and communicating with inside of the first housing;

a check valve disposed on the first housing and communicating with inside of the first housing;

a pressure regulation assembly including a sleeve releasably fastened in the channel and having an axial tunnel communicating with inside of the first housing, a biasing member disposed in the tunnel, and a hub disposed on an end of the biasing member;

a hollow second housing including an internal space with the projection disposed therein, and a plurality of holes on an end, each of the holes having overlapping circular portions and of larger and smaller sizes;

a plurality of fasteners driven through the overlapping circular portions of smaller size of the holes into the first housing to secure the second housing, the pressure regulation assembly, and the first housing together;

a switch disposed on the first housing and communicating with inside of the first housing; and a pressure relief valve disposed on the first housing and communicating with inside of the first housing;

wherein in an unfastened state of the second housing, the fasteners are configured to drive through the overlapping circular portions of larger size of the holes.

* * * * *